US010038242B2

(12) United States Patent
Imai et al.

(10) Patent No.: US 10,038,242 B2
(45) Date of Patent: Jul. 31, 2018

(54) ANTENNA COMPONENT

(71) Applicant: Murata Manufacturing Co., Ltd., Nagaokakyo-shi, Kyoto-fu (JP)

(72) Inventors: Ryoji Imai, Nagaokakyo (JP); Takeshi Arai, Nagaokakyo (JP); Tsugumichi Nagaoka, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 127 days.

(21) Appl. No.: 15/202,811

(22) Filed: Jul. 6, 2016

(65) Prior Publication Data

US 2016/0315388 A1 Oct. 27, 2016

Related U.S. Application Data

(63) Continuation of application No. PCT/JP2014/083708, filed on Dec. 19, 2014.

(30) Foreign Application Priority Data

Jan. 20, 2014 (JP) ..... 2014-007900

(51) Int. Cl.
*H01Q 7/08* (2006.01)
*H01Q 1/32* (2006.01)
*H01F 5/02* (2006.01)

(52) U.S. Cl.
CPC ..... *H01Q 7/08* (2013.01); *H01Q 1/3241* (2013.01); *H01F 2005/022* (2013.01)

(58) Field of Classification Search
CPC ..... H01Q 1/3241; H01Q 7/08; H01Q 1/3233; H01Q 7/06
See application file for complete search history.

(56) References Cited

U.S. PATENT DOCUMENTS

2004/0252068 A1* 12/2004 Hall ..... H01Q 1/22 343/788
2007/0091007 A1* 4/2007 Sako ..... H01Q 1/40 343/788

(Continued)

FOREIGN PATENT DOCUMENTS

JP S59152703 A 8/1984
JP 2005175965 A 6/2005

(Continued)

OTHER PUBLICATIONS

International Search Report issued for PCT/JP2014/083708, dated Mar. 10, 2015.

(Continued)

*Primary Examiner* — Daniel J Munoz
(74) *Attorney, Agent, or Firm* — Arent Fox LLP

(57) ABSTRACT

An antenna component providing a large output. The antenna component includes a magnetic core and a coil antenna including a first coil portion to an nth coil portion (n being an integer more than two) wound around the magnetic core. The first coil portion to the nth coil portion are electrically connected in series and are spaced apart from each other and arranged in the order from the first to nth coil portions. The number of turns of each of the second coil portion to the (n−1)th coil portion is smaller than the number of turns of each of the first coil portion and the nth coil portion.

17 Claims, 4 Drawing Sheets

(56) References Cited

U.S. PATENT DOCUMENTS

| | | | | |
|---|---|---|---|---|
| 2010/0164822 | A1* | 7/2010 | Iwasaki | H01Q 1/3241 343/788 |
| 2011/0241957 | A1* | 10/2011 | Ohara | H01Q 1/3241 343/788 |
| 2014/0198011 | A1* | 7/2014 | Tsubaki | H01Q 7/06 343/867 |

FOREIGN PATENT DOCUMENTS

| | | | |
|---|---|---|---|
| JP | H04287407 | A | 6/2005 |
| JP | 2007288345 | A | 11/2007 |
| JP | 2012239020 | A | 12/2012 |
| WO | WO 2008056601 | A1 | 5/2008 |

OTHER PUBLICATIONS

Written Opinion of the International Searching Authority issued for PCT/JP2014/083708, dated Mar. 10, 2015.

* cited by examiner

ANTENNA COMPONENT

CROSS REFERENCE TO RELATED APPLICATIONS

The present application is a continuation of PCT/JP2014/083708 filed Dec. 19, 2014, which claims priority to Japanese Patent Application No. 2014-007900, filed Jan. 20, 2014, the entire contents of each of which are incorporated herein by reference.

FIELD OF THE INVENTION

The present disclosure relates to antenna components and, in particular, to an antenna component used in a short-range wireless communication system.

BACKGROUND OF THE INVENTION

One known example antenna component is a transmission antenna coil described in Patent Document 1. The transmission antenna coil includes a magnetic core and leads. The magnetic core has a stick shape extending along a predetermined direction. A first winding portion and a second winding portion are formed by winding the leads. The first winding portion and second winding portion are spaced apart from each other in the predetermined direction. In this transmission antenna coil, a magnetic flux leaks from between the first winding portion and second winding portion, a rise in self-inductance is reduced, a Q factor decreases. This results in a wide resonance range and improved broadness in the transmission antenna coil.

There is a desire to achieve a larger output in the above-described transmission antenna coil in Patent Document 1.

Patent Document 1: Japanese Unexamined Patent Application Publication No. 2005-175965.

SUMMARY OF THE INVENTION

Accordingly, it is an object of the present disclosure to provide an antenna component from which a large output is obtainable.

An antenna component is disclosed that includes a magnetic core and a coil antenna including a first coil portion to an nth coil portion (n being an integer more than two) wound around the magnetic core. The first coil portion to the nth coil portion are electrically connected in series and are disposed such that they are spaced apart from each other and arranged in the order from the first to nth coil portions. The number of turns of each of the second coil portion to the (n−1)th coil portion is smaller than the number of turns of each of the first coil portion and the nth coil portion.

In the above-described antenna component, preferably, the magnetic core may have a stick shape extending along a predetermined direction, and the first coil portion to the nth coil portion may be disposed such that they are spaced apart from each other in the predetermined direction and arranged in the order from the first to the nth coil portions.

In the above-described antenna component, preferably, the first coil portion to the nth coil portion may be electrically connected in series in the order from the first to the nth coil portions.

In the above-described antenna component, preferably, the antenna component may be attached to a metal body for use.

According to the present disclosure, a large output can be obtained.

DETAILED DESCRIPTION OF THE EMBODIMENTS (Configuration of Antenna Component)

Figure 1:
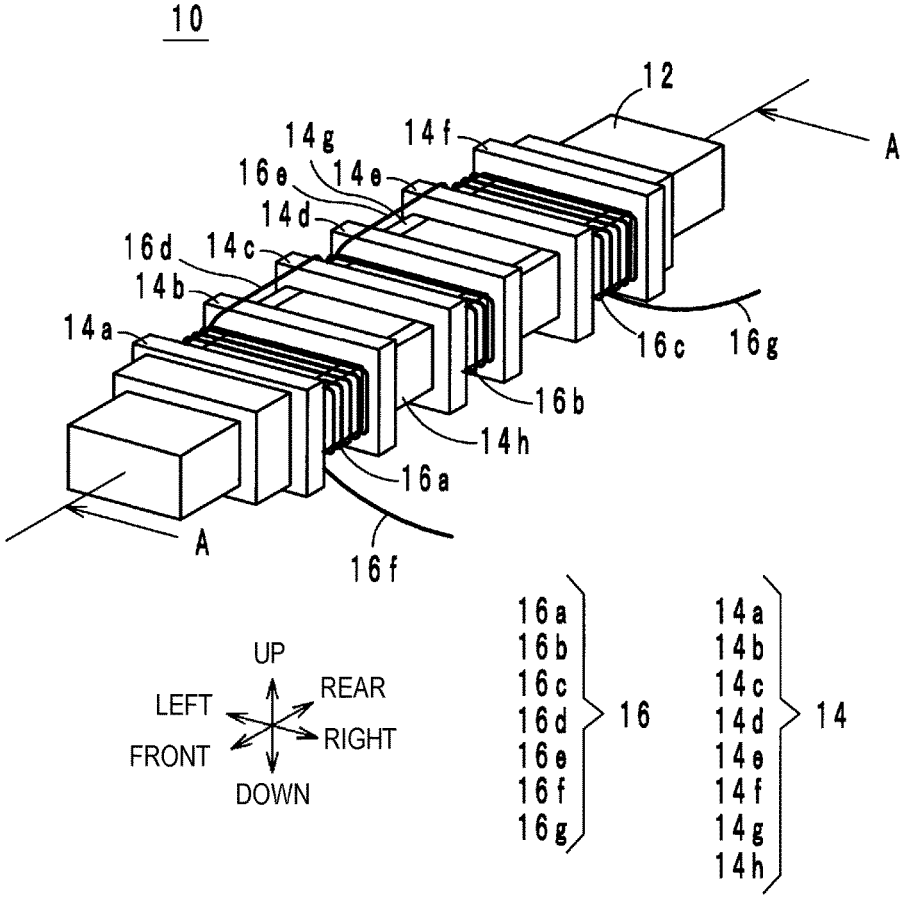
FIG. 1 is an external perspective view of an antenna component 10.
Figure 2:
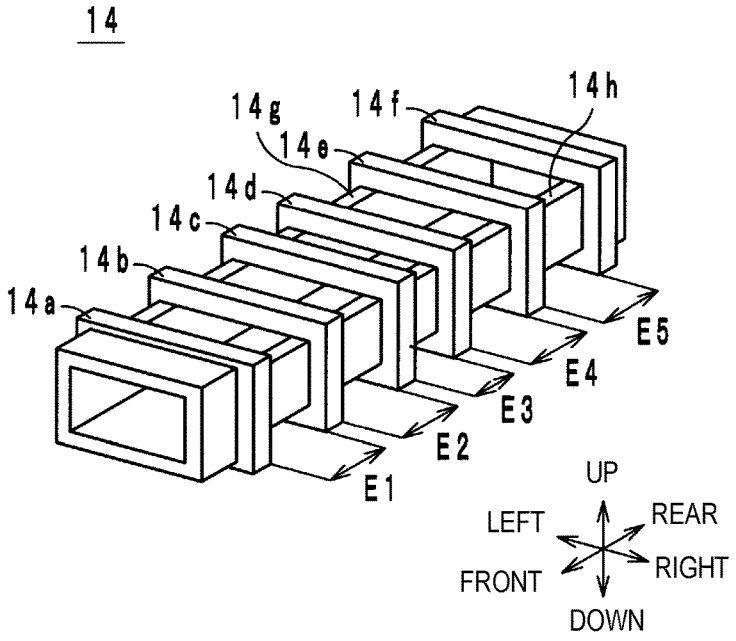
FIG. 2 is an external perspective view of a bobbin 14 in the antenna component 10.
Figure 3:
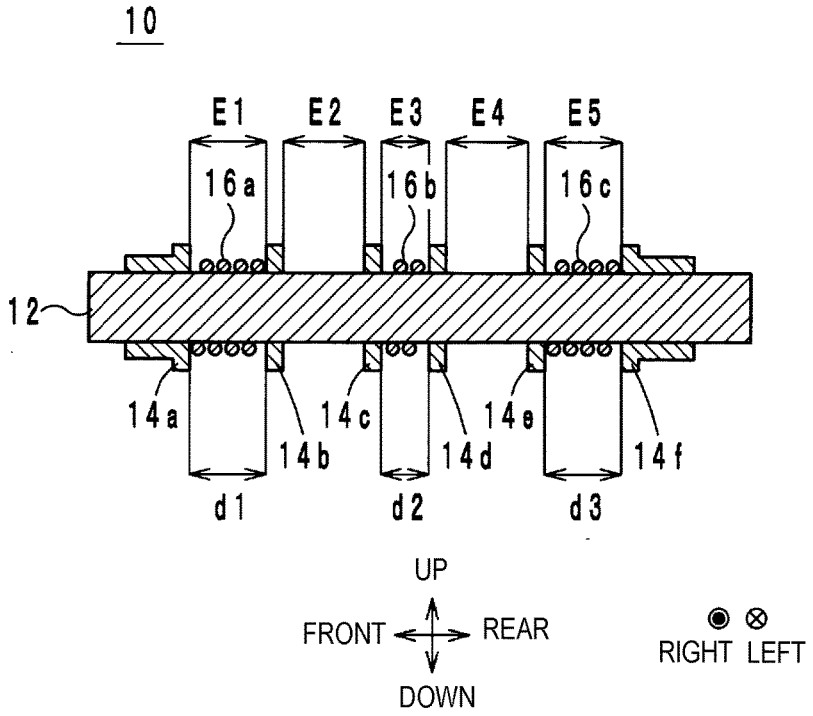
FIG. 3 is a cross-sectional structural view of the antenna component 10 taken along A-A.

A configuration of an antenna component according to an embodiment is described below with reference to the drawings. FIG. 1 is an external perspective view of an antenna component 10. FIG. 2 is an external perspective view of a bobbin 14 in the antenna component 10. FIG. 3 is a cross-sectional structural view of the antenna component 10 taken along A-A.

Hereinafter, the lengthwise direction of the antenna component 10 is defined as front-rear direction. The widthwise direction of the antenna component 10 is defined as left-right direction. The thickness direction of the antenna component 10 is defined as up-down direction. The front-rear direction, left-right direction, and up-down direction are perpendicular to each other. The front-rear direction, left-right direction, and up-down direction are directions defined for the sake of convenience and do not necessarily have to be the same as the front-rear direction, left-right direction, and up-down direction of the antenna component 10 in actual use.

The antenna component 10 is an antenna component for transmission in a short-range communication system in the low frequency (LF) range (30 kHz to 300 kHz) and is mainly used in a remote keyless system, in which a vehicle door is locked or unlocked by remote control. The antenna component 10 is typically mounted inside a door of the vehicle. Specifically, the antenna component 10 is configured to be attached on the back side of a door panel made of a material containing iron, although it should be appreciated that the metal in the material of the door panel can be another material besides iron.

As illustrated in FIG. 1, the antenna component 10 includes a magnetic core 12, a bobbin 14, and a coil antenna 16.

As illustrated in FIGS. 1 and 2, the bobbin 14 includes flange portions 14*a* to 14*f* and connecting portions 14*g* and 14*h*.

Each of the flange portions 14*a* to 14*f* has a rectangular frame shape as seen from the front side in plan view, and they are arranged in this order from the front side to rear side. That is, each of the flange portions 14*a* to 14*f* is configured by forming a rectangular hole in a plate member being rectangular as seen from the front side in plan view, the hole extending through the plate member in the front-rear direction. The size of the rectangular hole is virtually the same as the size of the magnetic core 12 as seen from the front side in plan view.

The connecting portion 14*g* is an elongated member extending in the front-rear direction and connects the left-side edges of the flange portions 14*a* to 14*f*. The connecting portion 14*h* is an elongated member extending in the front-rear direction and connects the right-side edges of the flange portions 14*a* to 14*f*.

Preferably, the bobbin 14 having the above-described configuration is produced by integral molding performed on polybutylene terephthalate (PBT).

The magnetic core 12 is a stick-shaped member extending along the front-rear direction and having a rectangular parallelepiped shape as seen from the up side in plan view. One example of the magnetic core 12 may be produced by compression molding in which impalpable powder of a manganese-zinc ferrite or other amorphous magnetic materials is formed into a flat board shape and firing it.

As illustrated in FIG. 1, the magnetic core 12 is placed in the bobbin 14 by being inserted from the front side or rear side. The front end of the magnetic core 12 protrudes forward from the flange portion 14*a*, and the rear end of the magnetic core 12 protrudes rearward from the flange portion 14*f*. Thus, the flange portions 14*a* to 14*f* encircle the magnetic core 12 such that they are positioned around the axis extending in the front-rear direction of the magnetic core 12. Accordingly, the bobbin 14 protects the magnetic core 12 and reduces the possibility of breakage of the magnetic core 12 caused by deformation, shock, or the like occurring during manufacturing or when the product is used.

Hereinafter, as illustrated in FIG. 2, the region between the flange portion 14*a* and flange portion 14*b* is referred to as region E1. The region between the flange portion 14*b* and flange portion 14*c* is referred to as region E2. The region between the flange portion 14*c* and flange portion 14*d* is referred to as region E3. The region between the flange portion 14*d* and flange portion 14*e* is referred to as region E4. The region between the flange portion 14*e* and flange portion 14*f* is referred to as region E5.

As illustrated in FIG. 3, the length d1 of the region E1 in the front-rear direction is virtually the same as the length d3 of the region E5 in the front-rear direction. The length d2 of the region E3 in the front-rear direction is shorter than each of the lengths d1 and d3.

The top surface and bottom surface of the magnetic core 12 in the regions E1 to E5 are exposed outside from the bobbin 14. The right surface and left surface of the magnetic core 12 are covered with the connecting portions 14*h* and 14*g*.

The coil antenna 16 is configured by winding a lead in which a surface of a core wire made of a conductive material, such as copper, is covered with an insulating material around the magnetic core 12. As illustrated in FIG. 1, the coil antenna 16 includes coil portions 16*a* to 16*c*, connecting portions 16*d* and 16*e*, and extended portions 16*f* and 16*g*.

The coil portion 16*a* is configured by winding a lead around the magnetic core 12 and connecting portions 14*g* and 14*h* in the region E1 and has a spiral shape. The coil portion 16*b* is configured by winding a lead around the magnetic core 12 and connecting portions 14*g* and 14*h* in the region E3 and has a spiral shape. The coil portion 16*c* is configured by winding a lead around the magnetic core 12 and connecting portions 14*g* and 14*h* in the region E5 and has a spiral shape. The coil portions 16*a* to 16*c* are wound in the same direction. The region E2 with no lead wound is present between the coil portion 16*a* and coil portion 16*b*. The region E4 with no lead wound is present between the coil portion 16*b* and coil portion 16*c*. Thus, the coil portions 16*a* to 16*c* are disposed such that they are spaced apart from each other and arranged in this order from the front side to rear side.

The connecting portion 16*d* connects the rear end of the coil portion 16*a* and the front end of the coil portion 16*b*. The connecting portion 16*e* connects the rear end of the coil portion 16*b* and the front end of the coil portion 16*c*. Thus, the coil portions 16*a* to 16*c* are electrically connected in series in this order.

The extended portion 16*f* is connected to the front end of the coil portion 16*a*. The extended portion 16*g* is connected to the rear end of the coil portion 16*c*.

The length d2 of the region E3 in the front-rear direction is shorter than each of the length d1 of the region E1 in the front-rear direction and the length d3 of the region E5 in the front-rear direction. Thus, the length of the coil portion 16*b* in the front-rear direction is shorter than that of each of the coil portions 16*a* and 16*c* in the front-rear direction. Accordingly, the number of turns of the coil portion 16*b* is smaller than that of each of the coil portions 16*a* and 16*c*. As shown in FIG. 3, the number of turns of each of the coil portions 16*a* and 16*c* is four, and that of the coil portion 16*b* is two. However, it should be appreciated that these numbers of turns are an example and in no way is the disclosed antenna component limited to this number of turns.

The antenna component 10 having the above-described configuration is attached to a door panel with an adhesive, double-sided adhesive tape, or the like for use. The extended portions 16*f* and 16*g* in the antenna component 10 are connected to a signal generating circuit.

According to the above antenna component 10, a large output is obtainable. More specifically, a magnetic-field output of the antenna component is determined by the ampere-turn of the coil antenna defined by Expression (1) below.

$$\text{Ampere-turn} = \text{Number of Turns} \times \text{Coil Current} \quad (1)$$

If the number of turns is increased to have a large magnetic-field output in the antenna component, the inductance value is increased and the resonant frequency is reduced, and it cannot be used at a desired frequency. Accordingly, if the number of turns of the coil antenna is increased, it is difficult to have a large output of the antenna component at a desired frequency.

Figure 4A:
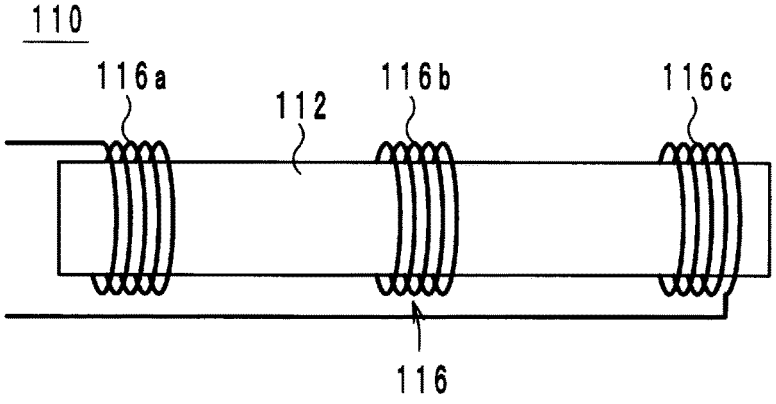
FIG. 4A is a schematic diagram that illustrates an antenna component 110 according to a comparative example.
Figure 4B:
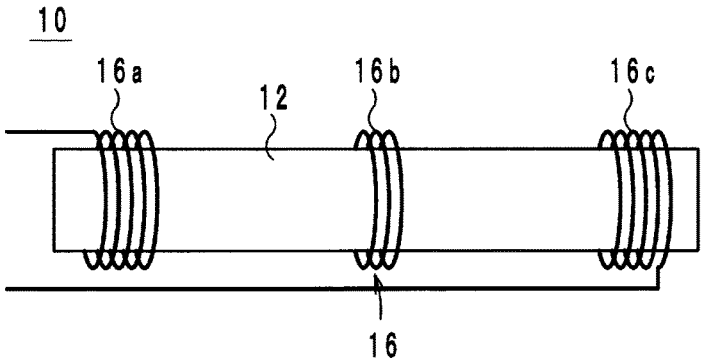
FIG. 4B is a schematic diagram of the antenna component 10.

The present inventor conceived a method of increasing the output of the antenna component 10 while suppressing an increase in the inductance value of the coil antenna 16 by an experiment described below. FIG. 4A is a schematic diagram that illustrates an antenna component 110 according to a comparative example. FIG. 4B is a schematic diagram of the antenna component 10.

The present inventor produced a first sample and a second sample of the antenna component 110 illustrated in FIG. 4A and a third sample and a fourth sample of the antenna component 10 illustrated in FIG. 4B. In the antenna component 110 illustrated in FIG. 4A, coil portions 116*a* and 116*b* have the same number of turns. In the antenna component 10 illustrated in FIG. 4B, the number of turns of the coil portion 16*b* is smaller than that of each of the coil portions 16*a* and 16*c*, which are positioned on opposite ends of the coil portion 16*b*, respectively. Table 1 below shows the details of the first to fourth samples. The present inventor designed the first to fourth samples such that they had the same inductance value to have the same resonant frequency in their coil antennas. The inductance value was adjusted by adjustment of the number of turns of each of the coil portions 16*c* and 116*c*.

TABLE 1

| | NUMBER OF TURNS | | | | | | |
|---|---|---|---|---|---|---|---|
| | TOTAL | COIL PORTION 16a, 116a | COIL PORTION 16b, 116b | COIL PORTION 16c, 116c | CORE LENGTH [mm] | INPUT CURRENT [A] | OUTPUT [dBμV/mrms] |
| 1ST SAMPLE | 79.5 | 26 | 26 | 27.5 | 40 | 1 | 95 |
| 2ND SAMPLE | 79.5 | 26 | 26 | 27.5 | 50 | 1 | 97 |
| 3RD SAMPLE | 83.5 | 33 | 17 | 33.5 | 40 | 1 | 95.4 |
| 4TH SAMPLE | 86.5 | 34 | 18 | 34.5 | 50 | 1 | 97.1 |

Figure 5:
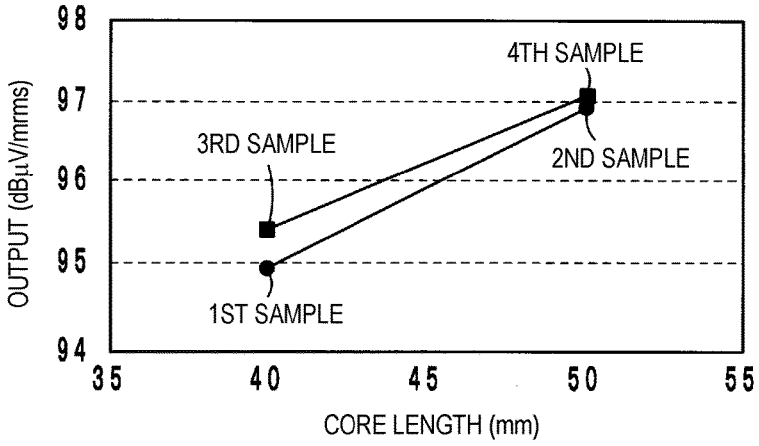
FIG. 5 is a graph that illustrates experimental results.

FIG. 5 is a graph that illustrates experimental results. The vertical axis indicates the output, and the horizontal axis indicates the length of the magnetic core in the front-rear direction. According to Table 1 and FIG. 5, although the first sample to fourth sample have the same inductance value, the number of turns of each of the third sample and fourth sample is larger than that of each of the first sample and second sample. They show that the output of the third sample is larger than that of the first sample and the output of the fourth sample is larger than that of the second sample. This experiment reveals that the antenna component 10 having an inductance value being small relative to the number of turns is obtainable by setting the number of turns of the coil portion 16*b* at a value smaller than that of each of the coil portions 16*a* and 16*c*. This can result in an increased number of turns of the coil antenna 16 and thus an increased output of the antenna component 10 without significant increase in the inductance value of the coil antenna 16. As described above, the output of the antenna component 10 can be increased by setting the number of turns of the coil portion 16*b* at a value smaller than that of each of the coil portions 16*a* and 16*c*.

According to the disclosed antenna component 10, when the antenna component 10 is attached to a metal body, such as a door panel, for use, a large output can be obtained. More specifically, in the transmission antenna component described in Patent Document 1, an increased number of turns leads to an increased inductance value and thus to a high Q factor in the transmission antenna coil. This results in a narrow resonance range and decreased broadness in the transmission antenna coil. The decreased broadness of the transmission antenna coil causes the output to tend to decrease because of the effects of the metal body positioned in the vicinity of the transmission antenna coil.

For the antenna component 10, in which the number of turns of the coil portion 16*b* is smaller than that of each of the coil portions 16*a* and 16*c*, as previously described, when the number of turns of the coil antenna 16 is increased, the inductance value of the coil antenna 16 does not easily increase. Accordingly, when the number of turns of the coil antenna 16 is increased to have a large output of the antenna component 10, the increase in the inductance value of the coil antenna 16 is suppressed. Thus, the increase in the Q factor of the coil antenna 16 is suppressed, and the decrease in the broadness of the antenna component 10 is suppressed. With the ensured broadness of the antenna component 10, when the antenna component 10 is positioned in the vicinity of a metal body, the decrease in the output of the antenna component 10 is suppressed. As described above, according to the antenna component 10, when the antenna component 10 is attached to a metal body, such as a door panel, for use, a large output can be obtained.

The metal body is a metal plate having first and second principal surfaces opposed to each other. The antenna component 10 is attached to the first principal surface of the metal body by adhesive fixing or by screws, for example. The area of the metal body is larger than that of the antenna component 10 when the metal body is seen from the first principal surface side in plan view. The metal body may preferably be disposed such that the antenna component 10 fully overlaps it when the metal body is seen from the first principal surface side. Depending on the specifications of the door panel, the metal body may have a cut or through-hole.

Other Embodiments

The antenna component according to the present disclosure is not limited to the antenna component 10, and any modification may be made without departing from the scope of the present invention.

Other coil portions may be added to the coil portions 16*a* to 16*c*, and thus the total number of coil portions may be four or more. When a first coil portion to an nth coil portion (n being an integer more than two) are disposed along the magnetic core, the number of turns of each of the second coil portion to the (n−1)th coil portion is less than smaller than that of each of the first coil portion and the nth coil portion. The first coil portion to the nth coil portion are arranged in this order from the front side to the rear side. When n is three according to an exemplary embodiment, the second coil portion is the (n−1)th coil portion.

The order in which the coil portions 16*a* to 16*c* are electrically connected in series is not limited to a numerical order of the first to nth coil portions. They may preferably be connected in the numerical order because the length of the connecting portion between the coil portions can be shortened.

The magnetic core 12 extends straight along the front-rear direction. The magnetic core 12 may curve.

As described above, the present disclosure is useful as an antenna component and in particular is advantageous in that a large output can be obtained.

REFERENCE SIGNS LIST

10 antenna component
12 magnetic core
14 bobbin
16 coil antenna
16*a* to 16*c* coil portions

The invention claimed is:

1. An antenna component comprising:

a magnetic core;

a bobbin disposed along a length of the magnetic core and having a plurality of flanges spaced apart from each other along the length of the magnetic core; and a coil antenna including a plurality of n coil portions wound around the magnetic core and connected in series with one another, with n being an integer greater than two, wherein the bobbin includes a plurality of connecting portions respectively disposed between the plurality of flanges, wherein the plurality of coil portions are each wound around a respective connecting portion of the plurality of connecting portions and spaced apart from each other along the bobbin and arranged in an order from a first coil portion to the nth coil portion, wherein a number of turns of the first coil portion and the nth coil portion is greater than a number of turns of a second coil portion to an (n−1)th coil portion, wherein the first and nth coil portions are wound around respective connecting portions that are longer than at least one connecting portion of which at least one of the second to (n−1)th coil portions is wound, and wherein no coil portion is wound around at least one connecting portion between the connecting portions of which the first and nth coils portions are wound around.

2. The antenna component according to claim 1, wherein the second coil portion and the (n−1) the coil portion comprise a single coil portion.

3. The antenna component according to claim 1, wherein the magnetic core comprises a stick shape extending in a first direction, and wherein the first coil portion to the nth coil portion are spaced apart from each other in the first direction.

4. The antenna component according to claim 1, wherein the first coil portion to the nth coil portion are electrically connected in series in the order from the first to the nth coil portions.

5. The antenna component according to claim 1, wherein the antenna component is configured to be attached to a metal body.

6. The antenna component according to claim 1, wherein the first coil portion and the nth coil portion comprise an equal number of turns.

7. The antenna component according to claim 1, wherein the plurality of coil portions are respectively wound around every other connecting portion of the plurality of connecting portions of the bobbin.

8. The antenna component according to claim 1, wherein top and bottom surfaces of the magnetic core are exposed outside from the bobbin.

9. The antenna component according to claim 1, wherein the bobbin is formed from polybutylene terephthalate.

10. An antenna component comprising:

a magnetic core;

a bobbin disposed along a length of the magnetic core and having a plurality of flange portions spaced apart from each other along the length of the magnetic core; and a coil antenna including at least three coil portions with each coil portion being disposed on a respective connection portion extending between a respective pair of the plurality of flange portions, wherein a pair of coil portions of the plurality that are closest to respective ends of the magnetic core each have a number of turns greater than a number of turns of at least one coil portion disposed between the pair of coil portions wherein the pair of coil portions are wound around respective connecting portions that are longer than a respective connecting portion of which the at least one coil portion between the pair of coil portions is wound, and wherein no coil portion is wound around at least one connecting portion between the respective connecting portions of which the pair of coils portions are wound.

11. The antenna component according to claim 10, wherein the at least one coil portion comprises a single coil portion.

12. The antenna component according to claim 10, wherein the magnetic core comprises a stick shape extending in a first direction and the plurality of coil portions are spaced apart from each other in the first direction.

13. The antenna component according to claim 10, wherein the plurality of coil portions are electrically connected in series to each other.

14. The antenna component according to claim 10, wherein the antenna component is configured to be attached to a metal body.

15. The antenna component according to claim 10, wherein the pair of coil portions of the plurality comprise an equal number of turns to one another.

16. The antenna component according to claim 10, wherein the plurality of coil portions are respectively wound around every other connecting portion of the plurality of connecting portions of the bobbin.

17. The antenna component according to claim 10, wherein top and bottom surfaces of the magnetic core are exposed outside from the bobbin.

* * * * *